US010845056B2

(12) United States Patent
Earle

(10) Patent No.: US 10,845,056 B2
(45) Date of Patent: Nov. 24, 2020

(54) LIQUID FUELLED TENT HEATER AND METHOD OF OPERATING SAME

(71) Applicant: International Thermal Research Ltd., Richmond (CA)

(72) Inventor: Chad Earle, Richmond (CA)

(73) Assignee: International Thermal Research Ltd., Richmond (CA)

( * ) Notice: Subject to any disclaimer, the term of this patent is extended or adjusted under 35 U.S.C. 154(b) by 153 days.

(21) Appl. No.: 15/860,777

(22) Filed: Jan. 3, 2018

(65) Prior Publication Data

US 2019/0203941 A1 Jul. 4, 2019

(51) Int. Cl.

| | |
|---|---|
| ***F24C 1/02*** | (2006.01) |
| ***F24C 5/18*** | (2006.01) |
| ***F24C 5/16*** | (2006.01) |
| ***F24C 5/20*** | (2006.01) |

(52) U.S. Cl.

CPC ..... *F24C 1/02* (2013.01); *F24C 5/16* (2013.01); *F24C 5/18* (2013.01); *F24C 5/20* (2013.01)

(58) Field of Classification Search

CPC ..... F24C 1/02; F22B 1/00

USPC ..... 126/94, 90 R

See application file for complete search history.

(56) References Cited

U.S. PATENT DOCUMENTS

| | | | | | |
|---|---|---|---|---|---|
| 2,174,572 | A * | 10/1939 | Esson | F24H 3/006 | 126/67 |
| RE22,482 | E * | 5/1944 | Schueder et al. | F24H 3/065 | 126/110 B |
| 4,606,282 | A * | 8/1986 | Steindal | F23B 1/16 | 110/116 |
| 6,422,231 | B1 * | 7/2002 | Hamilton | F24C 3/14 | 126/304 R |
| 7,270,122 | B2 * | 9/2007 | Jones | A47J 37/0704 | 126/25 R |

* cited by examiner

*Primary Examiner* — Avinash A Savani
(74) *Attorney, Agent, or Firm* — John Russell Uren

(57) ABSTRACT

A lightweight liquid fuelled heater for use in tents or shelters. A removable liquid fuelled burner is supplied by a fuel cannister and a pump to create pressure in the cannister. A flame plate restrains the flame in a desired position during combustion. The burner is positioned within a support plate in the heater and the burner is removable from the support plate and heater. The flame plate is likewise removable from the burner. An adjustable damper is mounted in the stack and an adjustment wheel is located externally of the heater to allow variable draft between startup and steady state combustion. A removable tray may be used for wood burning.

7 Claims, 16 Drawing Sheets

SECTION A - A

SECTION B - B

FIGURE 5A
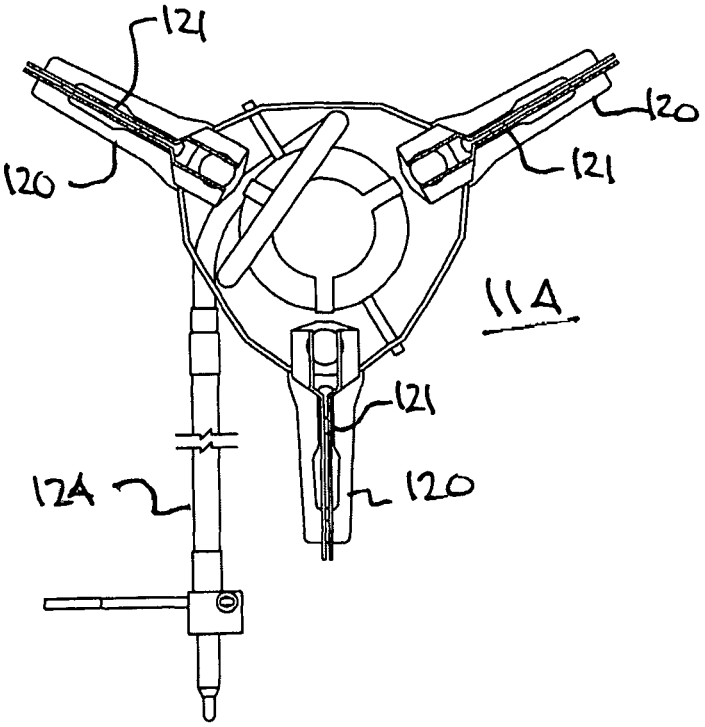
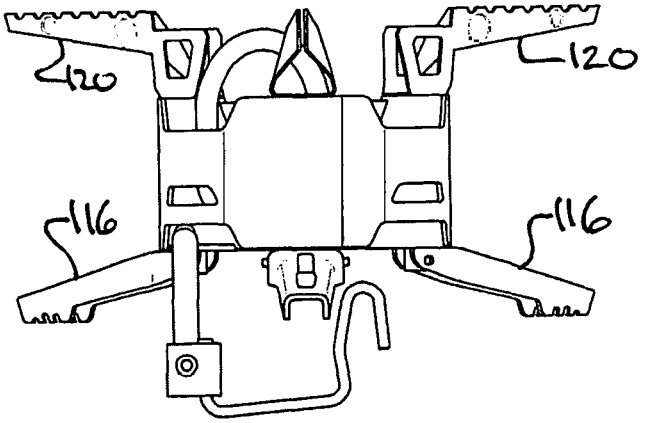
FIGURE 5B

200

LIQUID FUELLED TENT HEATER AND METHOD OF OPERATING SAME

INTRODUCTION

This invention relates to a liquid fuelled tent or shelter heater and, more particularly, for a liquid fuelled tent heater which is lightweight and portable for specific use by the military.

BACKGROUND OF THE INVENTION

A liquid fuelled burner manufactured by Mountain Safety Research (MSR) known as the XGK burner is a popular lightweight burner used by outdoorsmen. The burner is used with a hand operated pump which is connected to a liquid fuel cannister. The pump provides pressure within the cannister to force the liquid fuel to pass to the burner. The use of the burner, the pump and the fuel cannister are pervasive for simple cooking as provision is made on the top of the burner for placement of a cooking utensil allowing the preparation of hot water or food in a pot. The fuel canisters carrying a desired fuel such as white gas, gasoline, kerosene or diesel, are relatively light and easy to use. They are typically placed in position for use with the burner and may be reused or easily disposed of when exhausted.

Typically, this burner is not used for heating the environment. There is no provision to contain the heat emanating from the burner which principally passes to the utensil and otherwise dissipates in the ambient surroundings. If the burner is to be used for heating, there are many disadvantages. A first disadvantage is that there is no enclosure to contain the heat emanating from the burner. If there is a enclosure provided for the burner, there remains no control upon startup and emissions are high which are noxious to the user and can be deadly as there is no outside vent for the combustion gases. A third disadvantage is that the efficiency of such a burner for heating is very low upon startup and operation because of the lack of any way of controlling the heat generated by the burner.

SUMMARY OF THE INVENTION

According to one aspect of the invention, there is provided a liquid fuelled burner removably connected to a fuel supply supplying liquid fuel under pressure to said burner, a casing within which said liquid fuelled burner is positioned, a support plate within said casing to support said burner, said support plate having an opening within which said liquid fuelled burner is positioned, a first door in said casing to allow access to said burner, a second opening in the upper portion of said casing to allow a chimney stack to extend from said second opening and a damper in said casing, said damper moving between substantially open and substantially closed positions from a position externally of said casing to control communication of the combustion gases between the inside and outside of said casing.

According to a further aspect of the invention, there is provided a method of utilising a liquid fuelled burner to obtain heat emanating from a casing, said method comprising installing said liquid fuelled burner within a casing having a stack, installing a flame retaining member on the top of said burner, providing pressure within a liquid fuelled cannister connected to said burner, opening said cannister to allow fuel to pass from said cannister to said burner under pressure, lighting said burner by an access opening in said casing to allow combustion of said fuel, adjusting a damper to allow air to communicate between said casing and said stack upon burner startup, adjusting the fuel flow of said cannister so as to obtain a predetermined flame height from said burner within said casing, adjusting the movement of said damper from a position outside said casing thereby to adjust heat output from said casing.

According to yet a further aspect of the invention, there is provided a tray used for holding combustion material and being adapted for use in a liquid fuelled heater, said tray comprising first and second tray parts, each of said tray parts having a perimeter to hold said combustion material, a grid for each of said tray parts, said grid allowing support for said combustion material and to allow combustion byproducts to pass through said grid to said tray part and means for removably attaching said first and second tray parts within said heater.

BRIEF DESCRIPTION OF THE SEVERAL VIEWS OF THE DRAWINGS

Specific embodiments of the invention will now be described, by way of example only, with the use of drawings in which:

FIGS. 5A and 5B are plan and side views, respectively, of the burner positioned within the holes of the burner support plate illustrated in FIGS. 4A and 4B;

DESCRIPTION OF SPECIFIC EMBODIMENT

Figure 1:
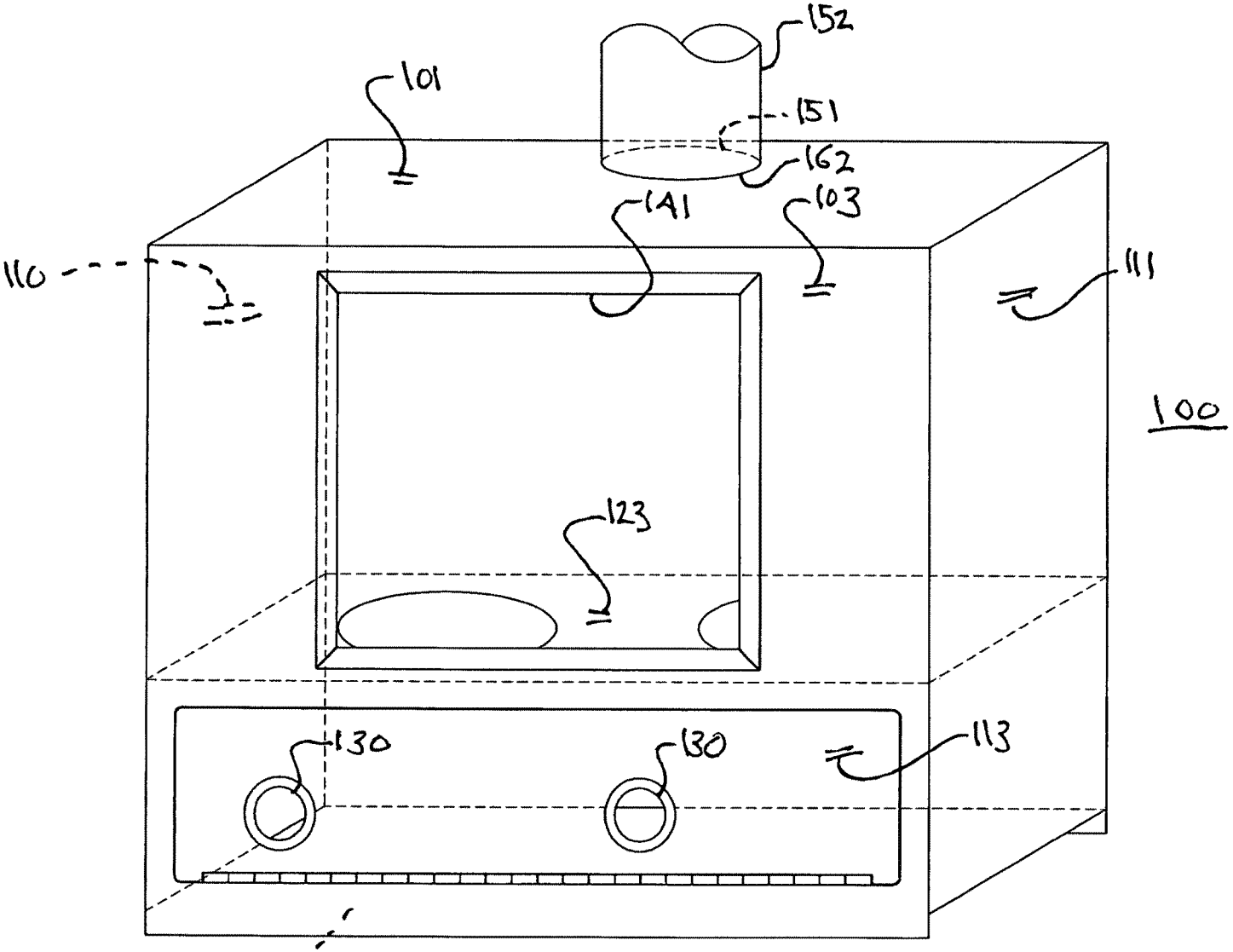
FIG. 1 is a diagrammatic isometric view of the heater according to the invention which includes the casing, the burner access door, the storage access door, two openings in a support plate within the casing wherein the burners are positioned, the stack opening on the top of the casing and a single segment of the chimney stack.

Referring now to the drawings, a heater according to the invention is generally illustrated at 100 in FIG. 1. It is made of cold rolled steel and welded together to form a generally rectilinear casing with top and bottom plates 101, 102, front and back plates 103, 104, side plates 110, 111 and two access doors 112, 113 used for burner installation and burner lighting and for storage, respectively.

Figure 4A:
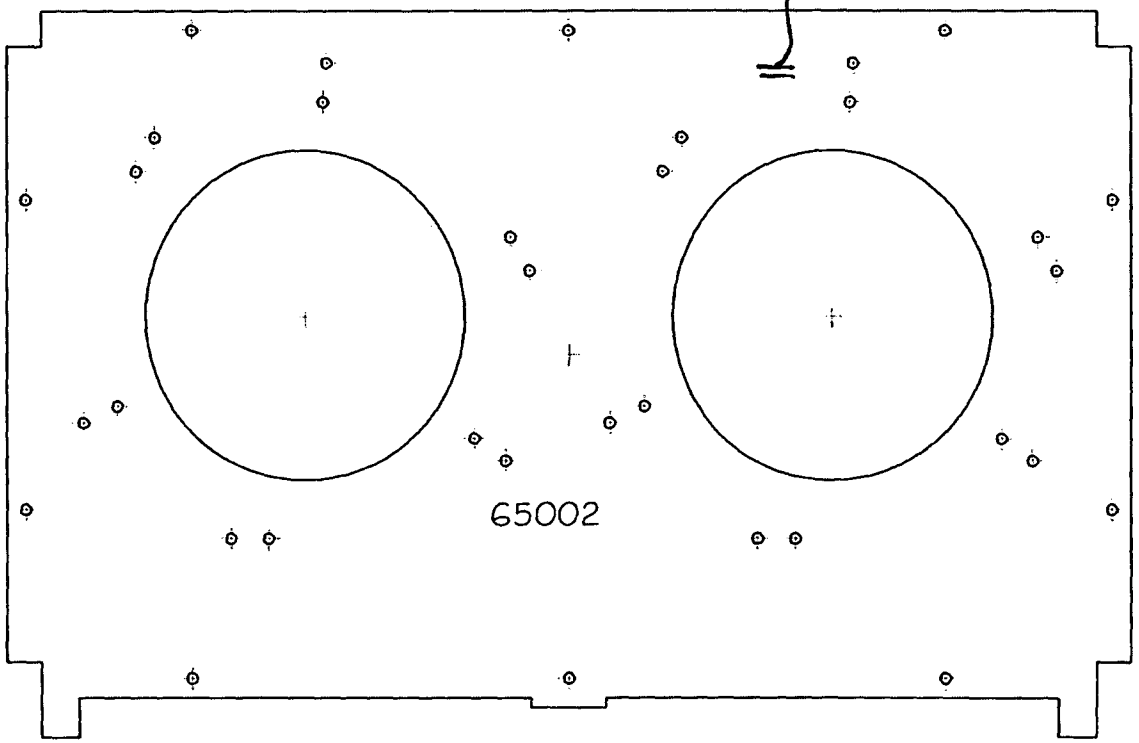
FIGS. 4A and 4B are plan and side views, respectively, of the burner support plate which is positioned within the casing to hold two burners.
Figure 4B:
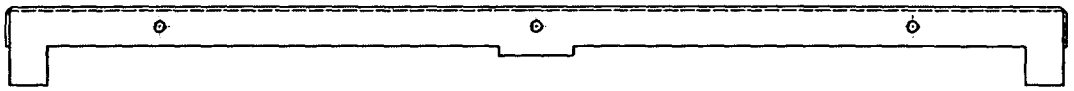
Figure 6C:
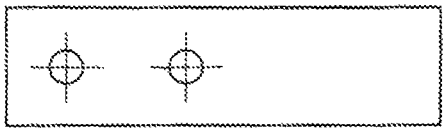
FIGS. 6A, 6B and 6C are side, plan and bottom views, respectively, of the burner holding tabs which are connected to the support plate to maintain the position of the burner when installed in the casing.
Figure 6B:
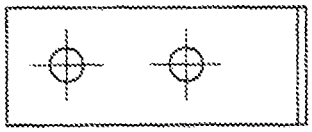
Figure 6A:
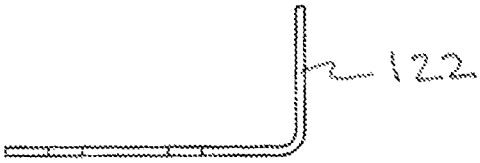

It will be appreciated that while two burners are preferably and conveniently used in the heater according to the invention, one or more than two may also be used and the description herein provided will apply to all such burners used. The liquid fuelled burner is shown generally at 114 in FIGS. 5A and 5B. The burner 114 is intended to burn white gas, kerosene, diesel and regular gasoline. Although there are other portable burners which may be used in the heater according to the invention, one suitable burner is the MSR XGK EX (Trademark) burner. This burner is typically used by outdoorsmen as a cooking stove for one pot meals and melting snow according to the manufacturer. The burner is illustrated in FIGS. 5A and 5B. It has bottom support legs 116 which rest on a surface when used for cooking and upper support legs 120 which are intended to support a pot (not shown) over the flame when in use for cooking. Each of the upper legs 120 has a recess 121 extending from top to bottom. These recesses will accommodate an L-shaped retaining tab 122 (FIG. 6A) which is mounted to the burner support plate 123 (FIGS. 1, 4A and 4B) as will be described. A fuel line 124, preferably flexible, extends from the burner 114 to a pump and fuel cannister (not shown). The pump is used to apply pressure to the cannister and a valve is provided in the pump to open the pressurized cannister to allow fuel flow from the reservoir to the burner 114. The fuel line 124 extends from the burner 114 to the pump and cannister through holes 130 (FIG. 2) in the lower storage door 113. Grommets 131 are inserted into holes 130 to prevent chaffing of the fuel line 124 on the metal door 113 and to offer noise reduction between the fuel lines 124 and the metal door 113.

Figure 7A:
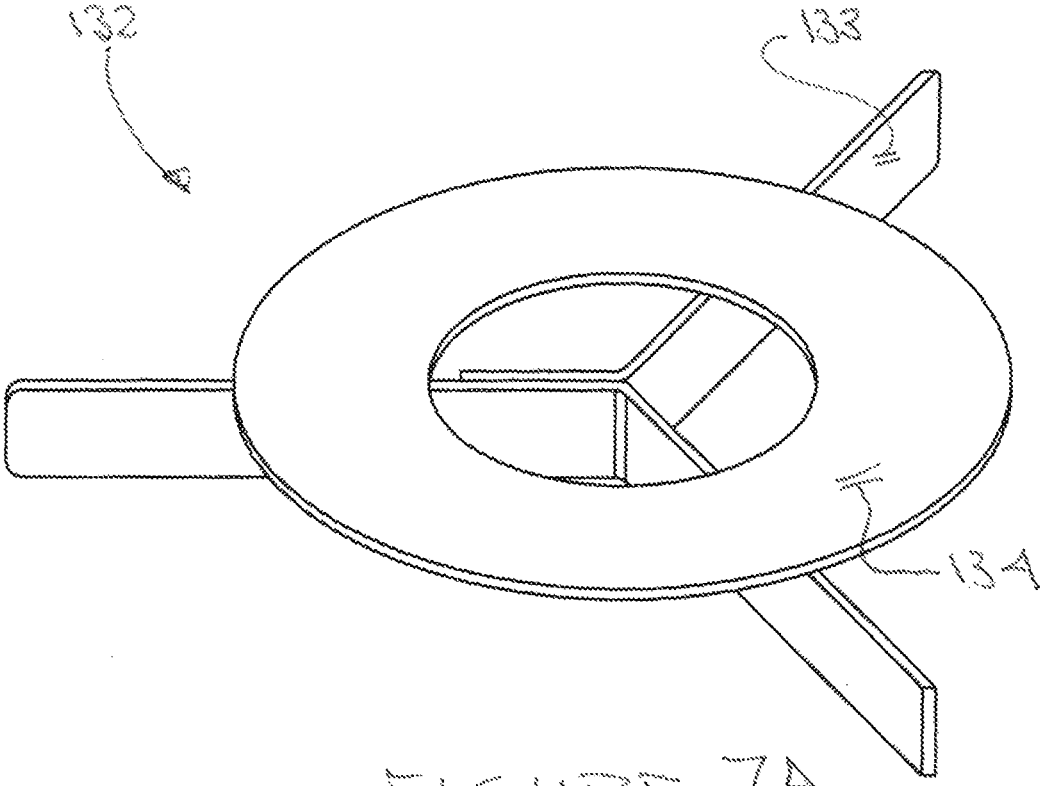
FIGS. 7A and 7B are diagrammatic plan and side views of the flame retaining plate positioned above the burner according to the invention.
Figure 7B:
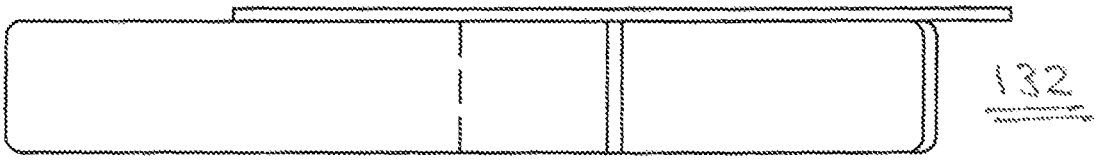
Figure 8B:
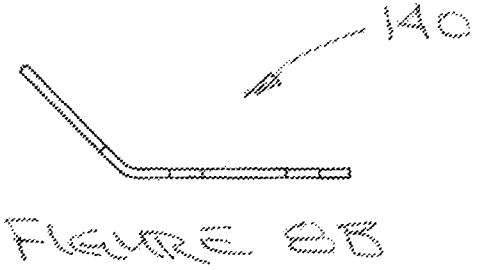
FIGS. 8A, 8B and 8C illustrate plan, side and bottom views, respectively, of the flame retaining plate tabs used to position the flame retaining plate.
Figure 8C:
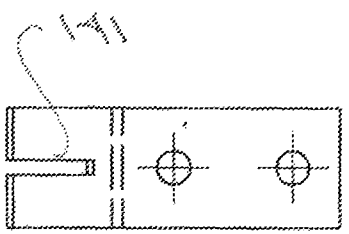
Figure 8A:
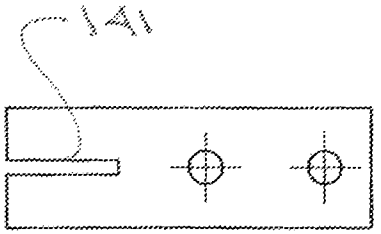
Figure 9A:
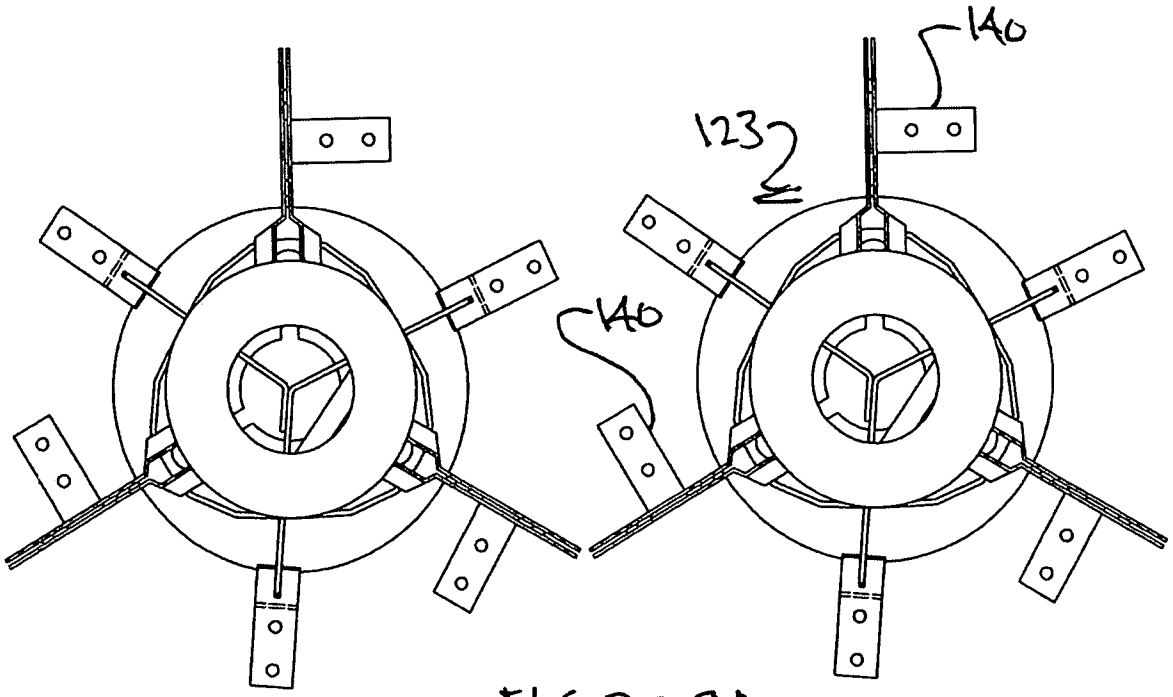
FIG. 9A is a diagrammatic plan view of the burners in their installed positions within the support plate of FIGS. 4A and 4B, particularly illustrating the flame retaining plate on top of the burners.

A flame retaining ring is illustrated generally at 132 (FIGS. 7A and 7B) and comprises three (3) legs 133 and the upper flame ring 134. The flame ring 134 is attached to the support legs 133 by welding. The flame retaining ring 132 is adapted to be positioned directly over the burner 114 when in operating position and is retained in place with the use of slotted tabs 140 (FIGS. 8A-8C) which are connected to the burner support plate 123 by rivets, welding or the like as best seen in FIG. 9A. Three slotted tabs 140 are connected to the support plate 123. Each of the slots 141 are of a dimension slightly larger than the thickness "t" of the ring legs 133 (FIG. 7A) such that the flame retaining ring 132 can be positioned and maintained in place by the slotted tabs 140 when the burner 114 is installed as will be described. The flame retaining ring 132 is removable from its operating position within the tabs 140 which allows the burner 114 to be readily inserted and removed from the heater 100 as also will be described. The burner 114 and the flame retaining ring 132 are both intended to be easily installed and removed from the heater 100 when desired as well as to be securely maintained in position during operation of the heater 100 and burner 114.

Figure 2:
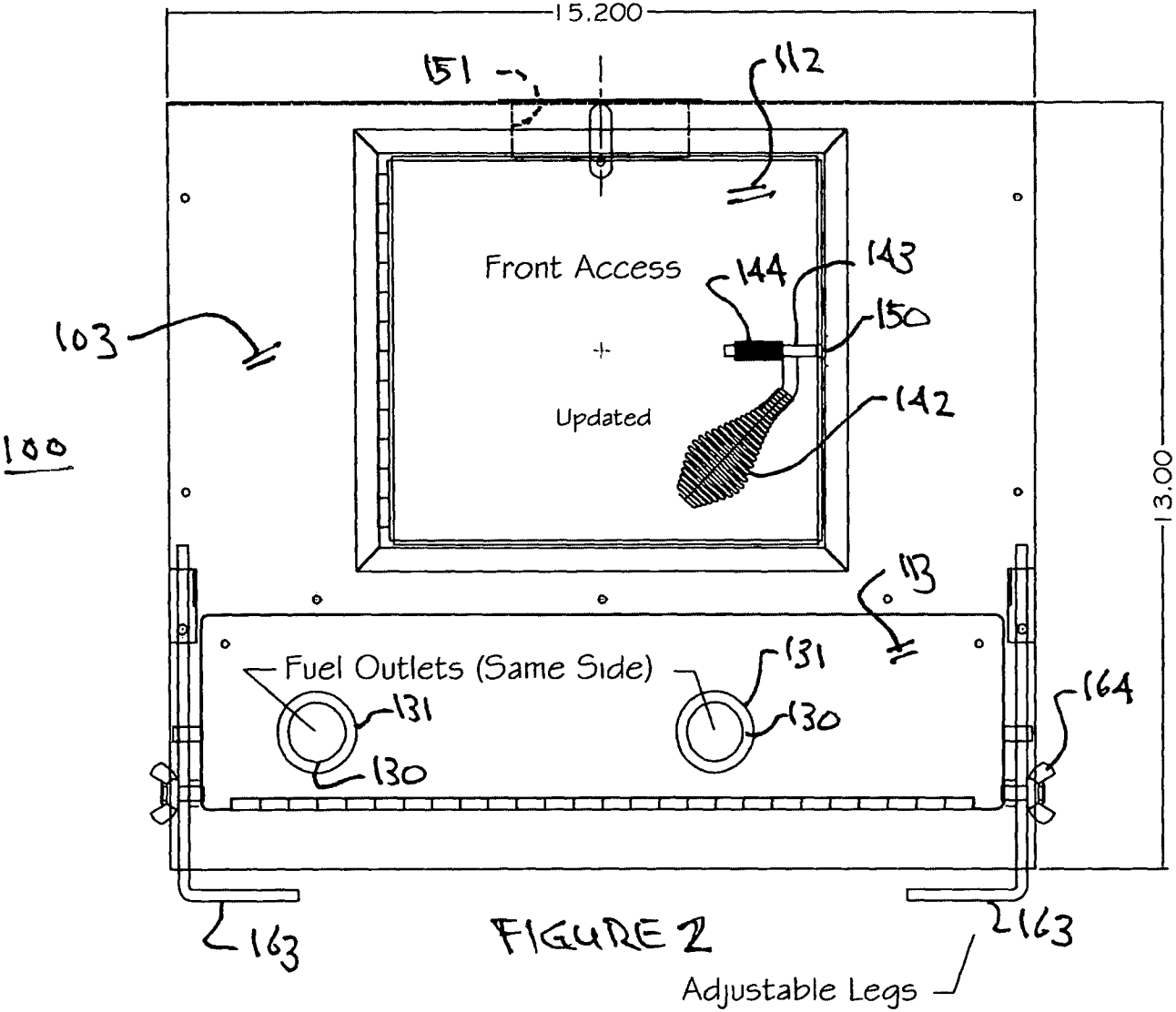
FIG. 2 is a diagrammatic front view of the casing of FIG. 1 particularly illustrating the burner access door, the storage door, the adjustable support legs and the position of the stack opening.

Door 112 (FIG. 2) on the front plate 103 of heater 100 is hinged on the left hand side as best seen in FIG. 2. A heat resisting handle 142 is connected to a pin 143 which is rotatable within a welded pin holder 144 and which extends into a mating hole 150 (see also FIG. 3) within a recess formed in the front plate 103 of the heater 100. By rotating the handle 142, the pin 143 can be inserted into and removed from the mating hole 150 thereby to open and close the burner access door 112.

Figure 3A:
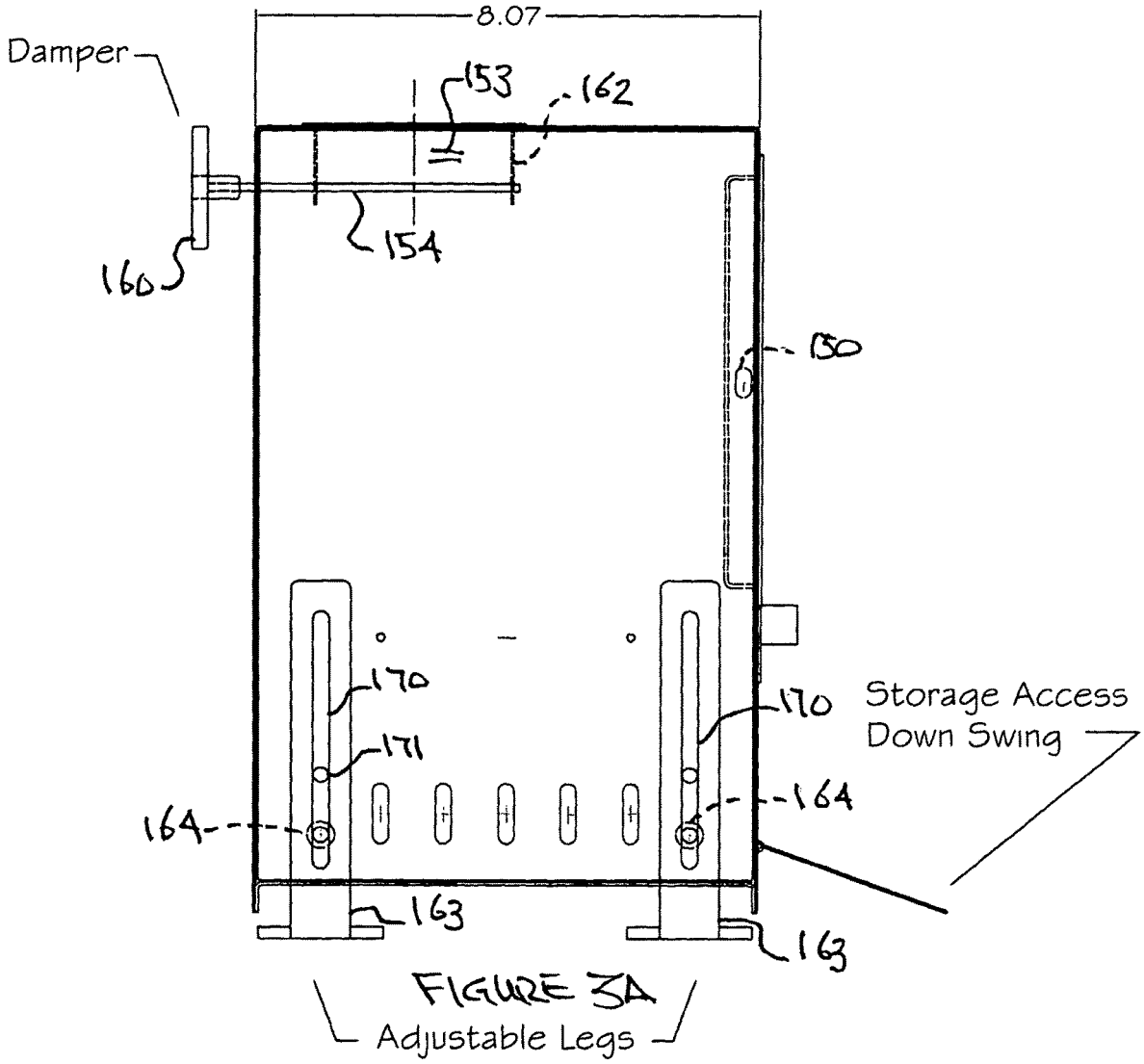
FIG. 3A is a diagrammatic end view of the casing of FIG. 1 particularly illustrating the adjustable support legs, the air access holes and the damper control wheel located externally of the casing.
Figure 3B:
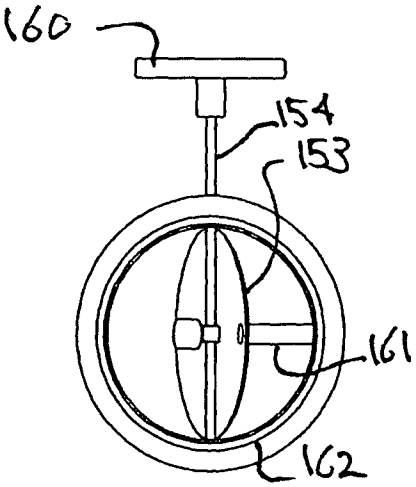
FIG. 3B is a diagrammatic plan view of the damper located in the supper surface of the heater and being in an open position.
Figure 3B:
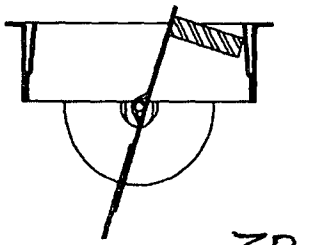
Figure 3C:
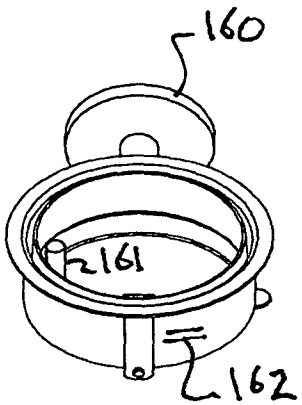
FIG. 3C is a diagrammatic isometric view of the damper of FIG. 3B but illustrating the damper in its closed position.
Figure 3C:
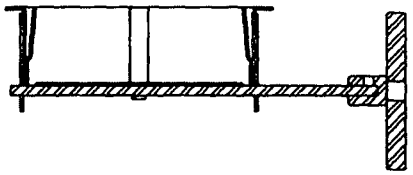
Figure 3D:
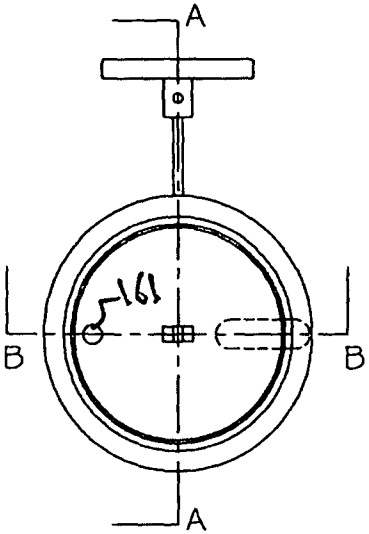
FIG. 3D is a diagrammatic bottom view of the damper of FIG. 3C also in its closed position.
Figure 3D:
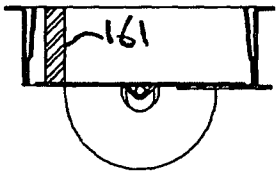

A stack hole 151 (FIGS. 1 and 2) is provided on the top surface 101 of the heater 100 with a collar 162 extending downwardly from the top surface 101 which will accommodate a segment 152 of the chimney stack. The stack hole 151 and collar 162 allows the insertion and removal of chimney stack, only a segment 152 of which is illustrated. A damper 153 (FIG. 3B) is mounted on a damper shaft 154 (FIG. 3B) which shaft 154 is rotated by an externally located damper wheel 160. The damper 153 is rotatable between fully open and fully closed positions by the wheel 160. A pin 161 (FIG. 3B) is mounted to the damper 153. In the fully closed position as illustrated in FIG. 3D, the pin 161 extends vertically. In the fully open position, the pin 161 will contact and abut the chimney collar 162 so as to limit the movement of the damper 153 to its fully open position as seen in FIG. 3B.

A set of support legs 163 (FIGS. 2 and 3A) are adjustable by means of adjustment screws 164 which allow the movement of the legs 163 generally by way of pins 171 within slots 170 as required for level operation of the heater 100 under operation. When the desired operating position is reached, the adjustment screws 164 are tightened thereby to maintain the support legs 163 in their desired position.

Operation

In operation, the heater 100 will be positioned within a shelter or tent in the desired position and the adjustable legs 163 will be extended or retracted to allow for a level operating position. The storage access door 113 will be opened and the stack segments will be removed and one bottom segment 152 will be positioned in the chimney collar 162 in stack hole 151. The chimney stack will extend to a tent collar (not illustrated) in the tent or shelter and it is intended that the tent collar can similarly be stored in the heater storage area. The burner access door 112 will be likewise opened. It will be appreciated that two or more burners 114 may be installed although a single burner 114 could also be used.

Burner 114 is installed in the burner support plate 123 from the top of the burner support plate 123 and the fuel line 124 will be inserted first with the burner 114 following. The cooking support legs 121 will then be positioned on top of the burner support plate 123 and each of the cooking support legs 121 will be positioned such that each of the three (3)

L-shaped burner retaining tabs 122 extend through each recess 121 so that the support legs 120 contact the burner support plate 123 and are maintained in position with contact between the plate 123 and the burner retaining tabs 122 within the support leg recesses 121. The flame retaining rings 132 will be positioned on top of the burners 114 and will be maintained in their central positions by contact between the legs 133 and the slots 141 in tabs 140.

The fuel lines 124 of the burners 114 are inserted through the grommet openings 130 and connected to the fuel reservoir and pump (not illustrated).

The pump connected to the fuel cannister is pumped to create a positive pressure within the fuel cannister and a valve is opened to move the fuel to the burner 114 as is all known. The damper wheel 160 (FIG. 3A) is rotated to its fully open position with the pin 161 abutting the stack hole 151 as seen in FIG. 3B. A flame is then applied to the burner 114 through the storage access door 113. The burner 114 is now alight. The storage access door 113 is then closed.

With the damper 153 in its open position and the flame retaining ring 132 acting to constrain the flame, upon startup, the combustion will be inefficient and the combustion byproducts will pass through the stack to the ambient surrounding of the tent or shelter. As the flame heat improves combustion efficiency by heating the fuel, the flame will move towards its steady operating condition. The damper 153 will be moved towards its closed position seen in FIG. 3D resulting in higher burner efficiency and heat generation. The burner 114 will be burning clean and efficient under the influence of the damper 153 and the flame retaining ring 132. The heater will radiate the heat generated by the burner 114 into the surroundings within the tent or shelter where it is positioned.

When operation is complete, the flame retaining plate 132 and burners 114 can easily be removed and used for their original purpose if desired. The chimney stack segments 152 can likewise be removed and stored together with a number of the fuel canisters within the recess defined at the front by the storage access door 113 in the front of the heater 100.

A further embodiment of the invention is illustrated in FIGS. 9B-13. This embodiment is particularly useful for wood burning and comprises a tray generally illustrated at 200 (FIG. 11B) which is fitted for insertion into the heater 100 (FIG. 2) through the burner access door 112 when it is in the open position as will be explained.

Figure 10:
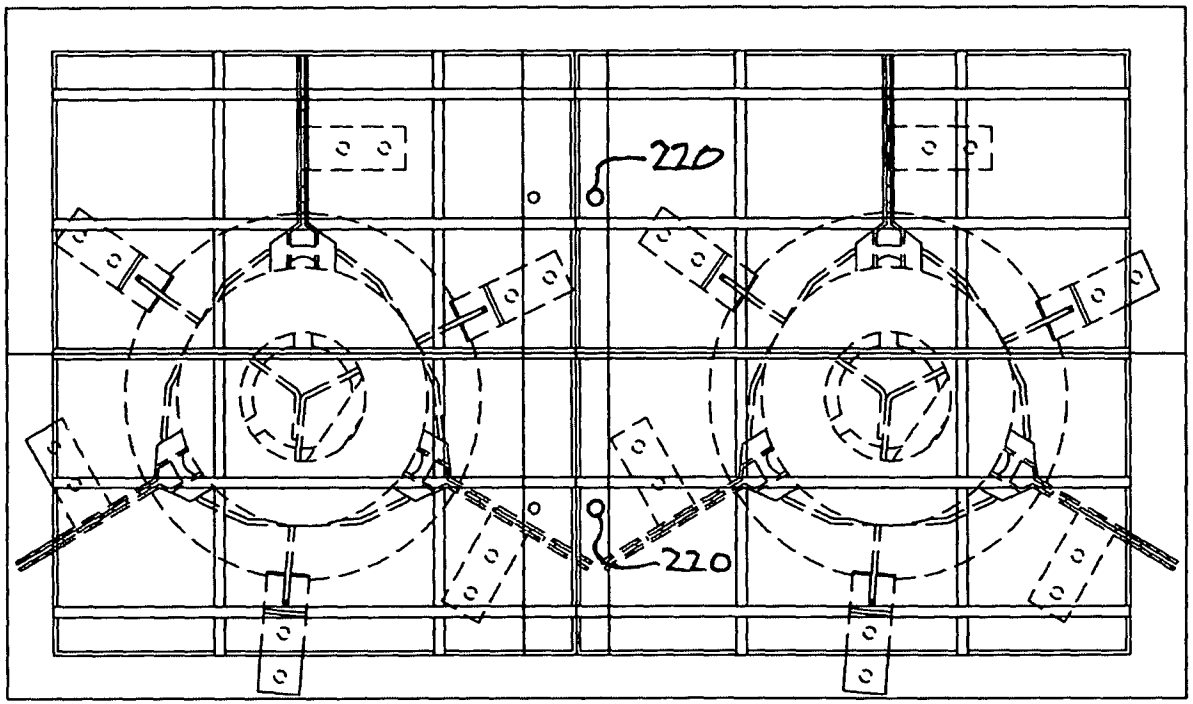
FIG. 10 is a diagrammatic plan view similar to FIG. 9B but further illustrating the holding tray positioned on the liquid fuelled burners.
Figure 11A:
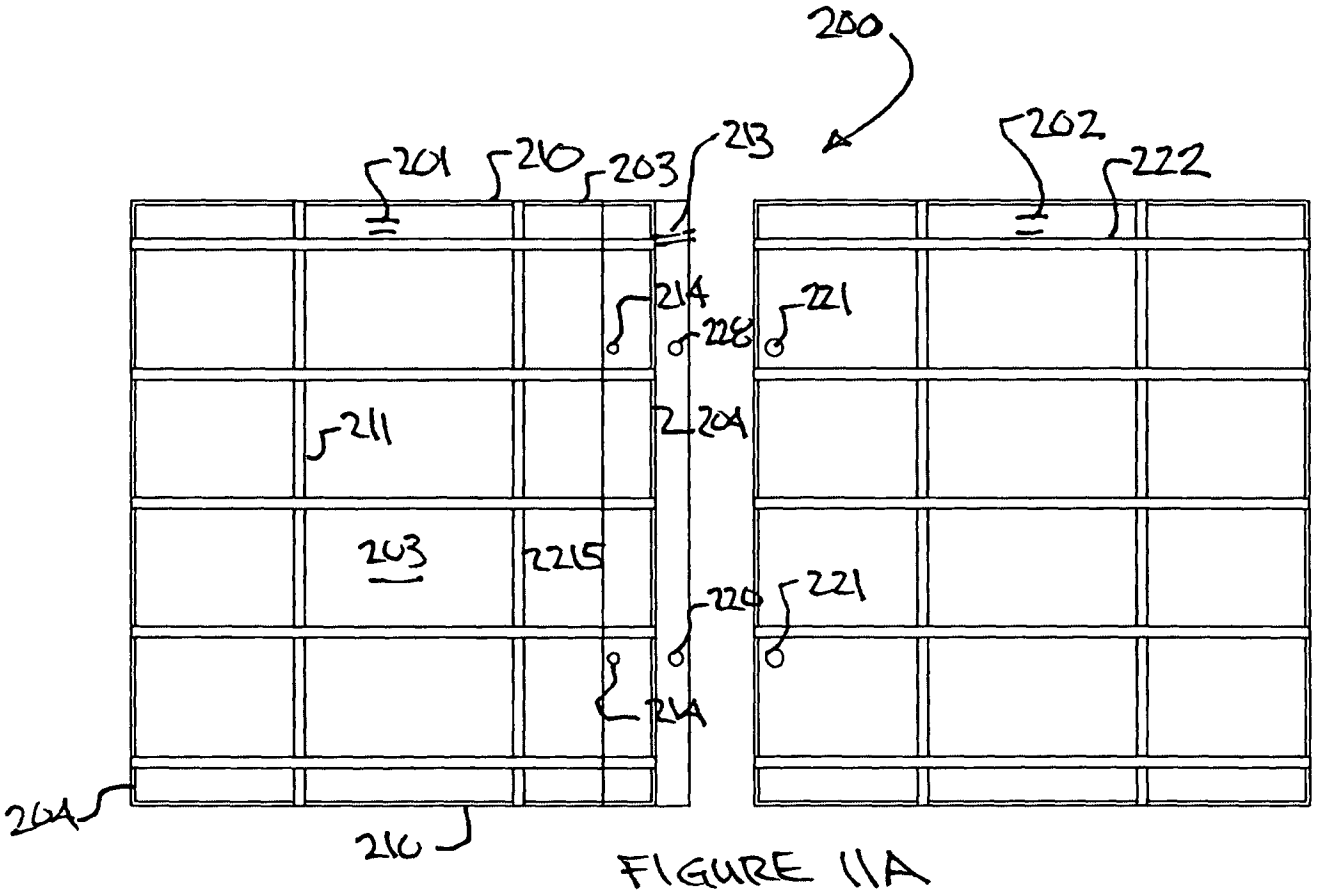
FIGS. 11A and 11B are diagrammatic plan views illustrating the holding tray according to a further aspect of the invention in both the disassembled and assembled configurations, respectively.
Figure 11B:
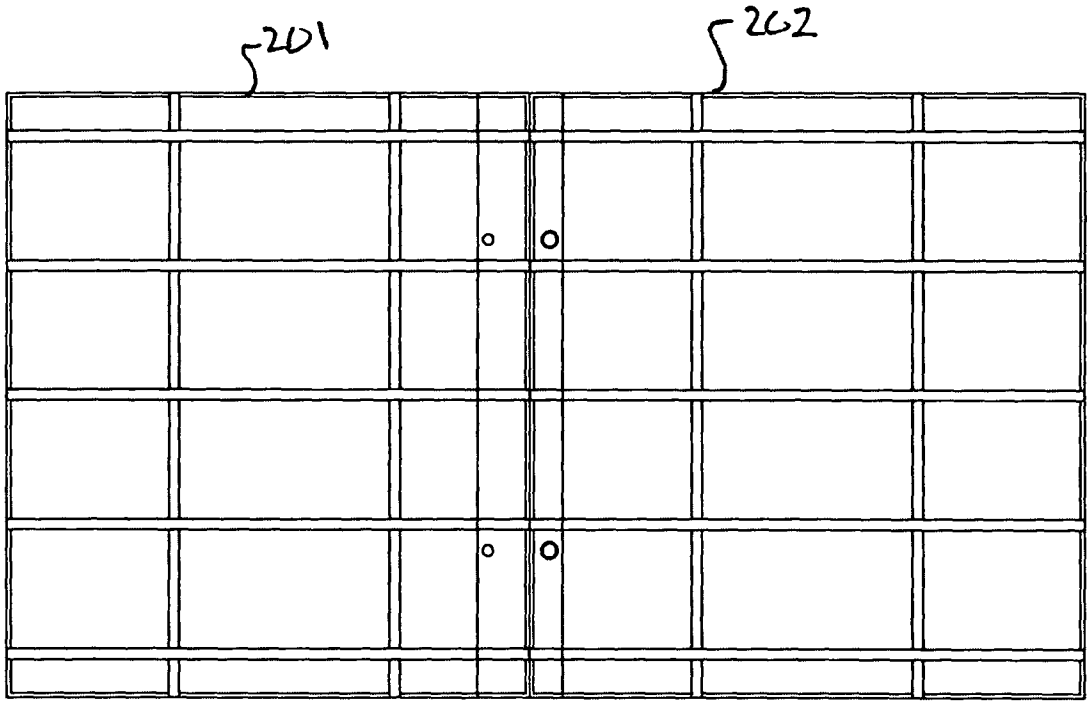
Figure 12B:
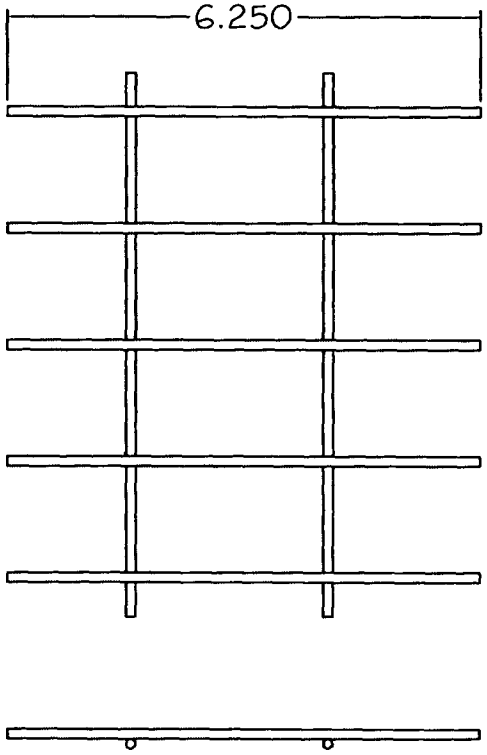
FIGS. 12A and 12B are diagrammatic plan views of the grids which are positioned within the holding tray, for the left and right hand sides, respectively.
Figure 12A:
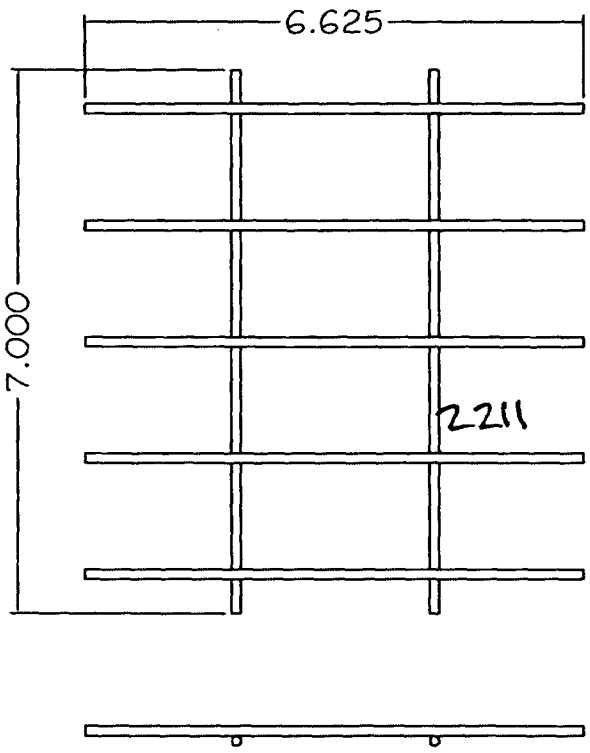
Figure 13B:
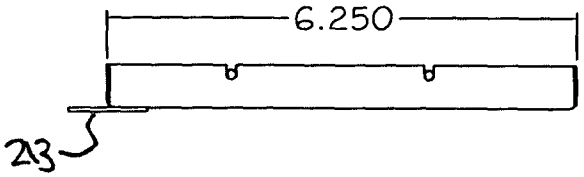
FIGS. 13A and 13B are side views of the holding trays, illustrating the grids of FIGS. 12A and 12B in their position within the holding trays.
Figure 13A:
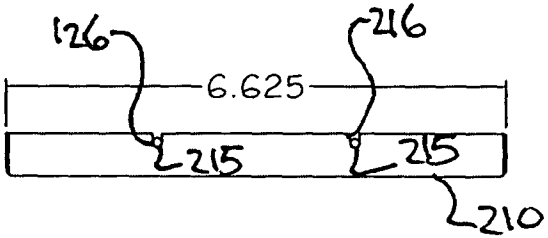

The tray 200 (FIGS. 11A and 11B) comprises two tray parts 201, 202 with slightly different configurations. Tray part 201 has a stainless steel tray 203 with upturned end and side pieces 204, 210. A grid 211 (see also FIG. 12A) is assembled with the top rods 212 of the grid 211 extending slightly above the plane formed by the upturned end and side pieces 204, 210 of the tray 203. The bottom rods 215 are adapted to fit complementary recesses 216 in tray part 210 as seen in FIG. 13A. A similar grid 222 is designed for tray part 202. A bottom elongate tab 213, best seen in FIGS. 11A and 13B, is welded to the bottom of tray part 201 with locating dimples 214 allowing for correct placement of tab 213 relative to tray part 201. Two pins 220 are welded to the top of tab 213 and extend upwardly. Pins 220 are designed to be complementary to openings 221 in tray part 202 as seen in FIG. 11A. When the two tray parts 201, 202 are assembled, the pins 220 will protrude upwardly from openings 221 and thereby hold the two tray parts 201, 202 in an assembled position as seen in FIGS. 9, 10 and 11B.

To assemble the tray 200 within the heater 100, the access door 112 (FIG. 2) is opened. It will initially be assumed that the two tray parts 201, 202 are in their separate and non-assembled configuration.

Figure 9B:
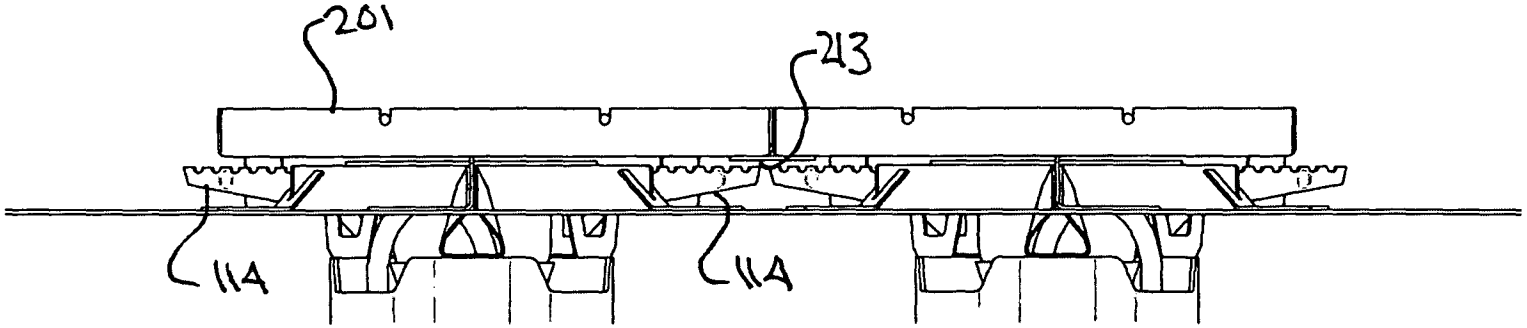
FIG. 9B is a diagrammatic and partial side view of the holding tray positioned on top of the liquid fuelled burners within the heater according to a further aspect of the invention.

Tray part 201 will be inserted through the open access door 112 and will be positioned facing upwardly as seen in FIG. 9B on top of the burner 114 with the flame retaining ring 132 in position on the top of the first burner 114 as previously described. Tray part 202 will subsequently also be inserted through the open access door 112 and will position the pin openings 221 over the pins 220 on tray part 201. It will be lowered into position on the second burner 114 with the pin 220 protruding through the pin openings 221. The two tray parts 201, 202 will then be firmly but flexibly assembled together within the heater 100 as seen in FIGS. 9B, 10 and 11B.

Firewood may then be inserted through the access door 112 of the heater 100 and positioned on top of the two tray parts 201, 202. Flame is used to ignite the firewood and the combustion will proceed as is known. Heat will be radiated from the heater 100. If desired, cooking on the top of the heater 100 is contemplated. The firewood may be supplemented as combustion proceeds simply by opening the access door 112 and inserting more firewood.

When combustion of the firewood is complete, the two tray parts 201, 202 may be removed by reversing the installation procedure. The firewood ashes are disposed of and the tray parts 201, 202 may be cleaned and again inserted to their previous position through the access door 112 as previously described if further firewood combustion is desired.

The two tray parts 201, 202 are also designed to be held and stored within the heater 100 by opening the storage access door 113 and inserting the two tray parts 201, 202 so that ready access to the tray parts 201, 202 is available in the event firewood combustion is desired such as may be the case, for example, where there is no fuel available for fuelling the two burners 114 through the use of fuel bottles (not shown).

Many other modifications will readily occur to those skilled in the art to which the invention relates. For example, automation is possible with automatic movement of the damper 153 depending upon heater temperature. A temperature sensor could adjust the flame output of the burner 114 and thereby maintain a desired ambient temperature of the heater 100. The adjustable support legs 163 could be replaced by a position adjustment lever which would make positioning the heater 100 more convenient than individually adjusting each leg 163 as described.

Many further embodiments may readily occur to those skilled in the art to which the heater relates and it will therefore be understood that the specific embodiments described are illustrative of the invention only and should not be taken as limiting its scope as defined in accordance with the accompanying claims.

I claim:

1. A heater casing for holding a removable liquid fuelled burner connected to a fuel supply supplying liquid fuel under pressure provided by a pump to said burner, a support plate within said casing to allow the insertion of said burner and support said burner, tabs connected to said support plate being retaining means to allow substantial vertical movement and to prohibit horizontal movement of said burner following installation of said burner within said tabs on said support plate, said support plate having a circular opening within which said liquid fuelled burner is positioned, a first access door in said casing having an opening, said first access door and said opening being of a size to allow insertion and removal of said burner, a second opening in the upper portion of said casing to allow a chimney stack to extend from said second opening and a damper in said casing, said damper having a control located outside of said casing to move said damper between substantially open and substantially closed positions to control communication of the combustion gases between the inside and outside of said casing.

2. A heater casing as in claim 1 and further comprising a flame plate removably mounted over the central portion of said burner, said flame plate being of a size that facilitates installation and removal through said first access door of said heater casing.

3. A method of utilising a liquid fuelled burner to obtain heat emanating from a heater casing, said method comprising installing said liquid fuelled burner through an access door of said casing, said access door being of a size to facilitate the removal and installation of said liquid fuelled burner and a flame retaining member within said casing having a stack, installing said flame retaining member on the top of said burner, providing pressure within a liquid fuelled cannister connected to said burner by a pump providing pressure to said cannister, opening said cannister to allow fuel to pass from said cannister to said burner under pressure from said pump, lighting said burner by an access opening in said casing to allow combustion of said liquid fuel, adjusting a damper to allow air to communicate between said casing and said stack upon burner startup with a damper control located outside said casing, adjusting the fuel flow from said cannister so as to obtain a predetermined flame height from said burner within said casing and adjusting the movement of said damper from said position outside said casing thereby to adjust heat output from said casing.

4. A heater casing as in claim 2 and further comprising a tray adapted to hold combustible material, said tray being removably positioned on the top of said burners, said tray being adapted to be positioned on the top of said burners by inserting said tray through said first access door of said heater and positioning said tray on top of said burners.

5. A heater casing as in claim 4 wherein said tray comprises a first and second tray part, said first and second tray parts being adapted to be assembled together within said heater after being inserted through said first access door of said casing.

6. A heater casing as in claim 5 wherein each of said tray parts is rectangular in shape and each include a grid adapted to support said combustible material, a tray part upon which said grid is positioned and means for attaching said tray parts to form said tray.

7. A heater casing as in claim 6 wherein said attaching means allows said tray parts to be attached within said heater by access through said first access door.

* * * * *